US008649707B2

(12) United States Patent
Kubo et al.

(10) Patent No.: US 8,649,707 B2
(45) Date of Patent: Feb. 11, 2014

(54) DEVELOPING DEVICE AND IMAGE FORMING DEVICE HAVING AN ADJUSTABLE DEVELOPING ROLL

(75) Inventors: Keisuke Kubo, Kanagawa (JP); Takeshi Okoshi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 304 days.

(21) Appl. No.: 13/004,547

(22) Filed: Jan. 11, 2011

(65) Prior Publication Data

US 2011/0318061 A1 Dec. 29, 2011

(30) Foreign Application Priority Data

Jun. 28, 2010 (JP) ..... 2010-146426

(51) Int. Cl.
*G03G 15/00* (2006.01)
*G03G 15/01* (2006.01)

(52) U.S. Cl.
USPC ..... 399/227; 399/126

(58) Field of Classification Search
USPC ..... 399/222, 279, 265, 126, 223, 227, 226; 384/256, 268, 626, 416, 418, 419, 247, 384/252, 261
See application file for complete search history.

(56) References Cited

U.S. PATENT DOCUMENTS

| | | | | |
|---|---|---|---|---|
| 3,343,484 | A * | 9/1967 | Dahlgren | 384/256 |
| 7,177,574 | B2 * | 2/2007 | Tanaka | 399/227 |
| 2005/0163539 | A1 * | 7/2005 | Nishimura | 399/279 |
| 2006/0115299 | A1 | 6/2006 | Tanaka | |

FOREIGN PATENT DOCUMENTS

| | | | |
|---|---|---|---|
| JP | 2002-311710 | | 10/2002 |
| JP | 2005106095 | A * | 4/2005 |

OTHER PUBLICATIONS

Chinese Office Action dated Nov. 14, 2013 issued in corresponding Chinese Patent Application No. 201110005862.X.

* cited by examiner

*Primary Examiner* — Susan Lee
(74) *Attorney, Agent, or Firm* — Sughrue Mion, PLLC

(57) ABSTRACT

A developing device includes: a developing roll; a bearing member that supports the developing roll rotatably, the bearing member including plural outer side surfaces, and distances from a center of a rotation axis of the developing roll to the outer side surfaces being different; and a supporting member that supports the bearing member in a positioning state where one of the plural outer side surfaces is in contact with a reference surface, the outer side surface in contact with the reference surface being changeable.

20 Claims, 7 Drawing Sheets

DEVELOPING DEVICE AND IMAGE FORMING DEVICE HAVING AN ADJUSTABLE DEVELOPING ROLL

CROSS-REFERENCE TO RELATED APPLICATION

This Application is based on and claims priority under 35 USC 119 from Japanese Patent Application No. 2010-146426 filed Jun. 28, 2010.

BACKGROUND

Technical Field

The invention relates to a developing device and an image forming device.

SUMMARY

An aspect of the invention is a developing device including: a developing roll; a bearing member that supports the developing roll rotatably, the bearing member including plural outer side surfaces, and distances from a center of a rotation axis of the developing roll to the outer side surfaces being different; and a supporting member that supports the bearing member in a positioning state where one of the plural outer side surfaces is in contact with a reference surface, the outer side surface in contact with the reference surface being changeable.

BRIEF DESCRIPTION OF THE DRAWINGS

Exemplary embodiments of the invention will be described in detail with reference to the following figures, wherein.

DETAILED DESCRIPTION

Hereinafter, an example of an exemplary embodiment according to the invention will be described based on drawings.

(Constitution of an Image Forming Device According to the Present Exemplary Embodiment)

Figure 1:
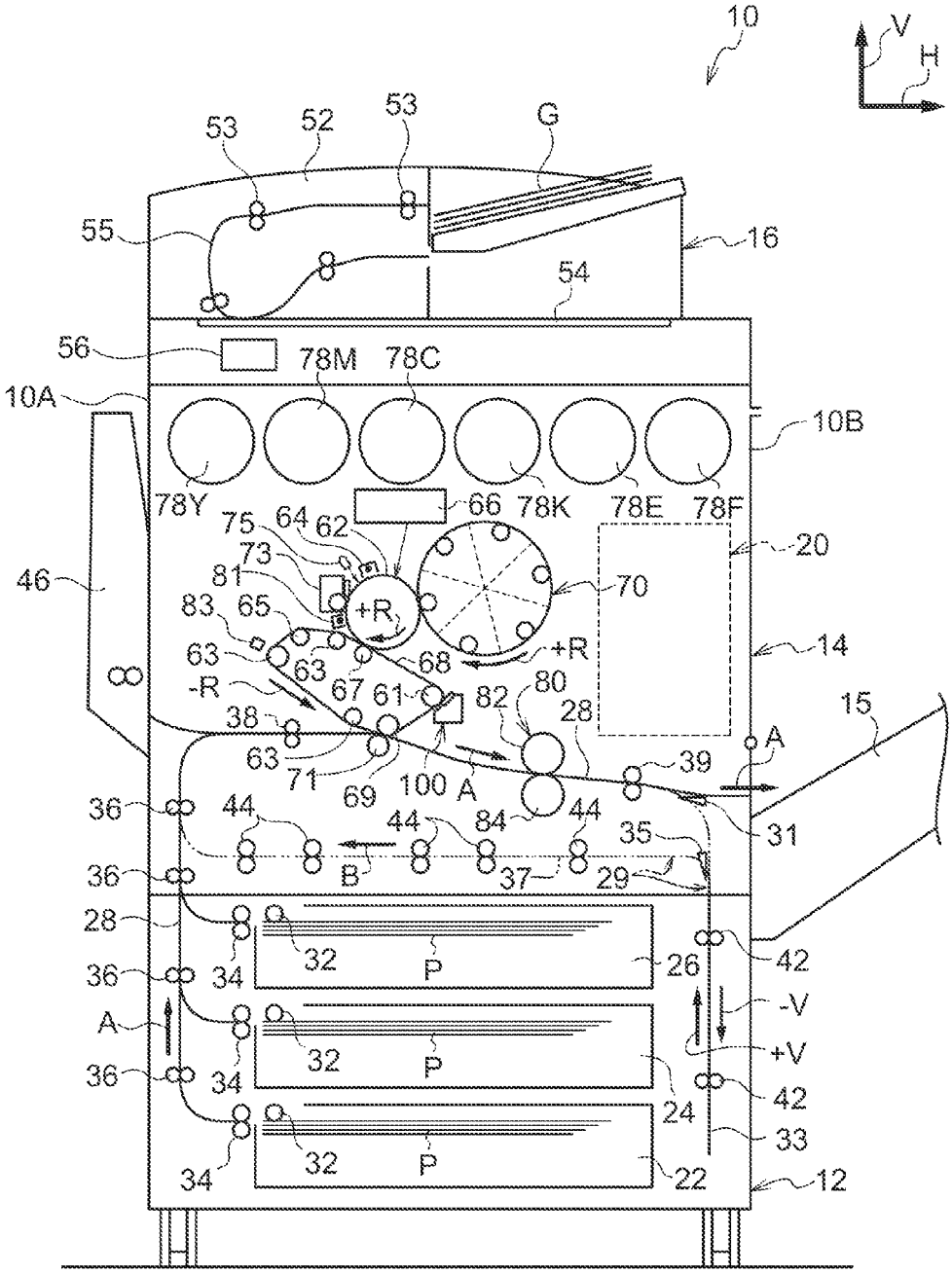
FIG. 1 is a schematic view showing a constitution of an image forming device according to the present exemplary embodiment.

First, a constitution of an image forming device according to the present exemplary embodiment will be described. FIG. 1 is a schematic view showing the constitution of the image forming device according to the present exemplary embodiment.

An image forming device 10 is configured to include a paper storage unit 12, an image forming unit 14, a document reading unit 16, and a control unit 20. The paper storage unit 12 stores a recording paper P as an example of recording medium. The image forming unit 14 is provided above the paper storage unit 12 and forms an image on the recording paper P supplied from the paper storage unit 12. The document reading unit 16 is provided above the image forming unit 14 and reads a read document G. The control unit 20 is provided in the image forming unit 14 and controls the operation of each section of the image forming device 10. In the following description, the up and down direction of a device body 10A of the image forming device 10 is described as an arrow V direction, and the horizontal direction is described as an arrow H direction.

The paper storage unit 12 is provided with a first storage section 22, a second storage section 24, and a third storage section 26 storing the recording papers P of different sizes. The first, second, and third storage sections 22, 24, and 26 each includes a feed-out roll 32 feeding out the stored recording paper P into a transporting path 28 provided in the image forming device 10. On the downstream side of each feed-out roll 32 in the transporting path 28, there are provided a pair of transporting rolls 34 and a pair of transporting rolls 36 transporting the recording papers P sheet by sheet. Further, on the transporting path 28 on the downstream side of the transporting rolls 36 in the transporting direction of the recording paper P, there is provided a positioning roll 38 temporarily stopping the recording paper P and feeding out the recording paper P to a second transfer position, to be described later, at a predetermined timing.

In the front view of the image forming device 10, the upstream side portion of the transporting path 28 is linearly provided in the arrow V direction from the left side of the paper storage unit 12 to the left side lower portion of the image forming unit 14. The downstream side portion of the transporting path 28 is provided from the left side lower portion of the image forming unit 14 to a paper discharge unit 15 provided on the right side surface of the image forming unit 14. The transporting path 28 is connected to a double-sided transporting path 29 in which the recording paper P is transported and reversed for image formation on the both sides of the recording paper P.

In the front view of the image forming device 10, the double-sided transporting path 29 includes a first switching member 31, a reversing section 33, a transporting section 37, and a second switching member 35. The first switching member 31 switches between the transporting path 28 and the double-sided transporting path 29. The reversing section 33 is provided linearly in the arrow V direction from the right side lower portion of the image forming unit 14 to the right side of the paper storage unit 12. In the transporting section 37, the rear end of the recording paper P transported to the reversing section 33 enters the transporting section 37, and the recording paper P is transported in the arrow H direction. The second switching member 35 switches between the reversing section 33 and the transporting section 37. Plural pairs of transporting rolls 42 are provided at the reversing section 33 with a distance therebetween, and plural pairs of transporting rolls 44 are provided at the transporting section 37 with a distance therebetween.

The first switching member 31 is a triangle pole shaped member, and a tip end portion of the first switching member 31 is moved toward the transporting path 28 or the double-sided transporting path 29 by a drive section (not shown in the drawings), whereby the transporting direction of the recording paper P is switched. Likewise, the second switching member 35 is a triangle pole shaped member, and a tip end portion of the second switching member 35 is moved toward the reversing portion 33 or the transporting section 37 by a drive section (not shown in the drawings), whereby the transporting direction of the recording paper P is switched. The downstream side end portion of the transporting section 37 is connected to the near side of a transporting roll 36 in the upstream side end portion of the transporting path 28 by a guide member (not shown in the drawings). The image forming unit 14 includes a collapsible manual paper feeding section 46 provided on the left side surface, so that the recording paper P can be transported from the manual paper feeding section 46 to the positioning roll 38 of the transporting path 28.

The document reading unit 16 is provided with a document transporting device 52, a platen glass 54, and a document reading device 56. The document transporting device 52 transports the read document G sheet by sheet. The platen glass 54 is disposed on the lower side of the document transporting device 52, and the read document G is put on the platen glass 54. The document reading device 56 reads the read document G transported by the document transporting device 52 or the read document G put on the platen glass 54. The document transporting device 52 includes a transporting path 55 with plural pairs of transporting rolls 53 arranged therein. A part of the transporting path 55 is disposed so that the recording paper P passes on the platen glass 54. The document reading device 56 reads the read document G transported by the document transporting device 52, stopping (remaining) at rest at the left end portion of the platen glass 54 or reads the read document G put on the platen glass 54, moving in the arrow H direction.

Meanwhile, the image forming unit 14 includes a cylindrical photoreceptor 62 provided at the central portion of the device body 10A. The photoreceptor 62 rotates in an arrow +R direction (a clockwise direction in FIG. 1) by a drive section (not shown in the drawings) and holds an electrostatic latent image formed by light emission. A corotron-type charger 64 charging a surface of the photoreceptor 62 is provided above the photoreceptor 62 and at the position of facing the outer peripheral surface of the photoreceptor 62.

An exposure device 66 is provided on the downstream side of the charger 64 in the rotation direction of the photoreceptor 62 and at the position of facing the outer peripheral surface of the photoreceptor 62. The exposure device 66 emits light onto (exposes) the outer peripheral surface of the photoreceptor 62, charged by the charger 64, based on an image signal corresponding to each toner color and forms an electrostatic latent image.

A rotation switching type developing device 70 is provided on the downstream side of a portion which is applied with exposure light from the exposure device 66 in the rotation direction of the photoreceptor 62. The developing device 70 develops an electrostatic latent image, formed on the outer peripheral surface of the photoreceptor 62, with a toner of a designated color and visualizes the electrostatic latent image. The specific constitution of the developing device 70 will be described later.

An intermediate transfer belt 68 is provided on the downstream side of the developing device 70 in the rotation direction of the photoreceptor 62 and on the lower side of the photoreceptor 62. A toner image formed on the outer peripheral surface of the photoreceptor 62 is transferred onto the intermediate transfer belt 68. The intermediate transfer belt 68 is an endless belt and is wound around a drive roll 61, a tension imparting roll 63, plural transporting rolls 65, and an auxiliary roll 69. The drive roll 61 is rotated and driven by the control unit 20. The tension imparting roll 63 is used for imparting tension to the intermediate transfer belt 68. The transporting rolls 65 driven-rotate with contacting with the rear surface of the intermediate transfer belt 68. The auxiliary roll 69 driven-rotates with contacting with the rear surface of the intermediate transfer belt 68 at the second transfer position which will be described later. The intermediate transfer belt 68 is circulatingly moved in an arrow −R direction (a counterclockwise direction in FIG. 2) by the rotation of the drive roll 61.

A first transfer roll 67 is provided on the opposite side of the photoreceptor 62 with the intermediate transfer belt 68 provided between the first transfer roll 67 and the photoreceptor 62. The first transfer roll 67 first-transfers a toner image, formed on the outer peripheral surface of the photoreceptor 62, onto the intermediate transfer belt 68. The first transfer roll 67 is in contact with the rear surface of the intermediate transfer belt 68 at a position which is away from the contact position of the photoreceptor 62 and the intermediate transfer belt 68 in the downstream side of moving direction of the intermediate transfer belt 68. The first transfer roll 67 is energized from a power source (not shown in the drawings) to thereby first-transfer the toner image on the photoreceptor 62 to the intermediate transfer belt 68 with a potential difference between the grounded photoreceptor 62 and the first transfer roll 67.

Further, a second transfer roll 71 is provided on the opposite side of the auxiliary roll 69 with the intermediate transfer belt 68 provided between the second transfer roll 71 and the auxiliary roll 69. The second transfer roll 71 is an example of a transfer member which second-transfers the toner image, first-transferred onto the intermediate transfer belt 68, onto the recording paper P. A position between the second transfer roll 71 and the auxiliary roll 69 is the second transfer position where a toner image is transferred onto the recording paper P. The second transfer roll 71 is in contact with the surface of the intermediate transfer belt 68. The second transfer roll 71 is energized from a power source (not shown in the drawings) to thereby second-transfer the toner image on the intermediate transfer belt 68 onto the recording paper P with a potential difference with the auxiliary roll 69 and the second transfer roll 71.

A cleaning device 100 is provided on the opposite side of the drive roll 61 with the intermediate transfer belt 68 provided between the cleaning device 100 and the drive roll 61. The cleaning device 100 is an example of a developer collecting device which collects a residual toner on the intermediate transfer belt 68 after the second transfer. In the cleaning device 100, a cleaning blade 106 is in contact with the intermediate transfer belt 68 to scrape and remove the toner. The cleaning blade 106 of the cleaning device 100 and the second transfer roll 71 are away from the outer peripheral surface of the intermediate transfer belt 68 until a toner image of each color is multiply transferred (first-transferred) onto the intermediate transfer belt 68 and second-transferred onto the recording paper P.

A position detection sensor 83 is provided around the intermediate transfer belt 68 and at the position of facing the tension imparting roll 63. The position detection sensor 83 detects a mark (not shown in the drawings) on the surface of the intermediate transfer belt 68 to thereby detect a predetermined reference position on the intermediate transfer belt 68 and outputs a position detection signal as a reference of a start timing of image formation processing.

A cleaning device 73 is provided on the downstream side of the first transfer roll 67 in the rotation direction of the photoreceptor 62. The cleaning device 73 performs cleaning, that is, removes residual toner and so on, which remains on the surface of photoreceptor 62 without being first-transferred onto the intermediate transfer belt 68. The cleaning device 73 is configured to collect the residual toner and so on by means of a cleaning blade and a brush roll in contact with the surface of the photoreceptor 62. An eraser 81 is provided on the upstream side of the cleaning device 73 (the downstream side of the first transfer roll 67) in the rotation direction of the photoreceptor 62. The eraser 81 applies light onto the outer peripheral surface of the photoreceptor 62 to remove electricity. Before the cleaning device 73 collects the residual toner and so on, the eraser 81 applies light onto the outer peripheral surface of the photoreceptor 62 to erase charge, and, thus, to reduce adhesion force caused by static and increases the collection rate of the residual toner and so on. An eraser section which erases charge after the collection of the residual toner and so on may be provided on the downstream side of the cleaning device 73 and on the upstream side of the charger 64.

As shown in FIG. 1, the second transfer position of the toner image by the second transfer roll 71 is set at an intermediate portion of the transporting path 28. A fixing device 80 is provided on the downstream of the second transfer roll 71 in the transporting direction (shown by the arrow A) of the recording paper P in the transporting path 28, and the fixing device 80 fixes a toner image onto the recording paper P on which the toner image is transferred by the second transfer roll 71. The fixing device 80 is constituted to include a heating roll 82 and a pressure roll 84. The heating roll 82 is disposed on the toner image surface side (upper side) of the recording paper P and includes a heat source generating heat by energization. The pressure roll 84 is disposed on the lower side of the heating roll 82 and pressurizes the recording paper P toward the outer peripheral surface of the heating roll 82. A transporting roll 39 is provided on the downstream side of the fixing device 80 in the transporting direction of the recording paper P in the transporting path 28 and transports the recording paper P toward the paper discharge section 15 or the reversing section 33.

Meanwhile, toner cartridges 78Y, 78M, 78C, 78K, 78E, and 78F are provided exchangeably so as to be arranged in a horizontal direction on the lower side of the document reading device 56 and the upper side than the developing device 70. The toner cartridges 78Y, 78M, 78C, 78K, 78E, and 78F respectively store toners of yellow (Y), magenta (M), cyan (C), black (K), first special color (E), and second special color (F).

The first and second special colors E and F are selected from special colors (including transparent color) other than yellow, magenta, cyan, and black, or are not selected. In the developing device 70, in a case where the first and second special colors E and F are selected, image formation is performed with the six colors Y, M, C, K, E, and F. In a case where the first and second special colors E and F are not selected, image formation is performed with the four colors Y, M, C, and K.

In the image forming device 10, an opening and closing portion 10B which is opened and closed with respect to the device body 10A is provided on the right side surface of the image forming unit 14.

(Specific Constitution of the Developing Device 70)

Next, a specific constitution of the developing device 70 will be described.

Figure 2:
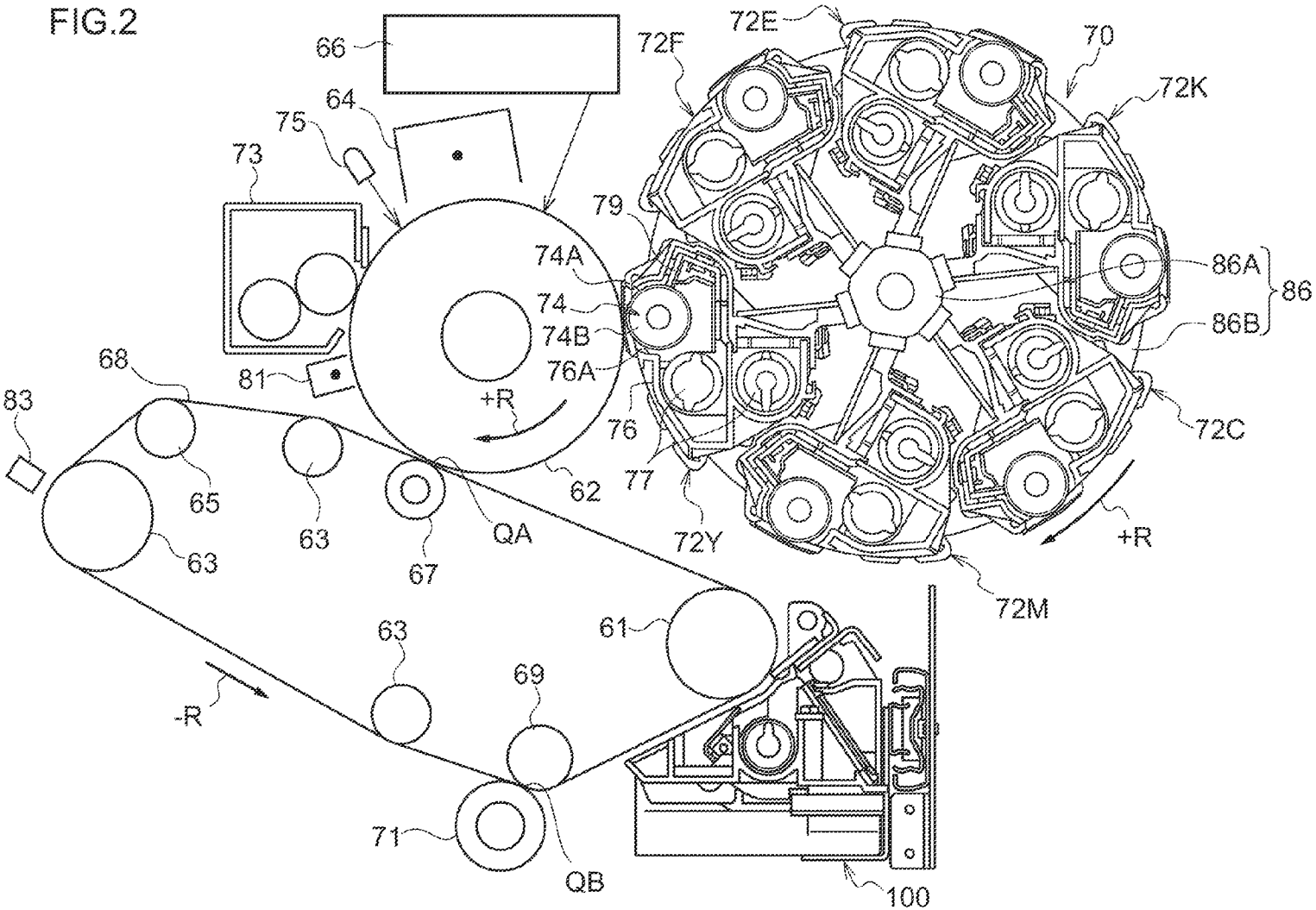
FIG. 2 is a schematic view showing a constitution around a photoreceptor according to the present exemplary embodiment.
Figure 3:
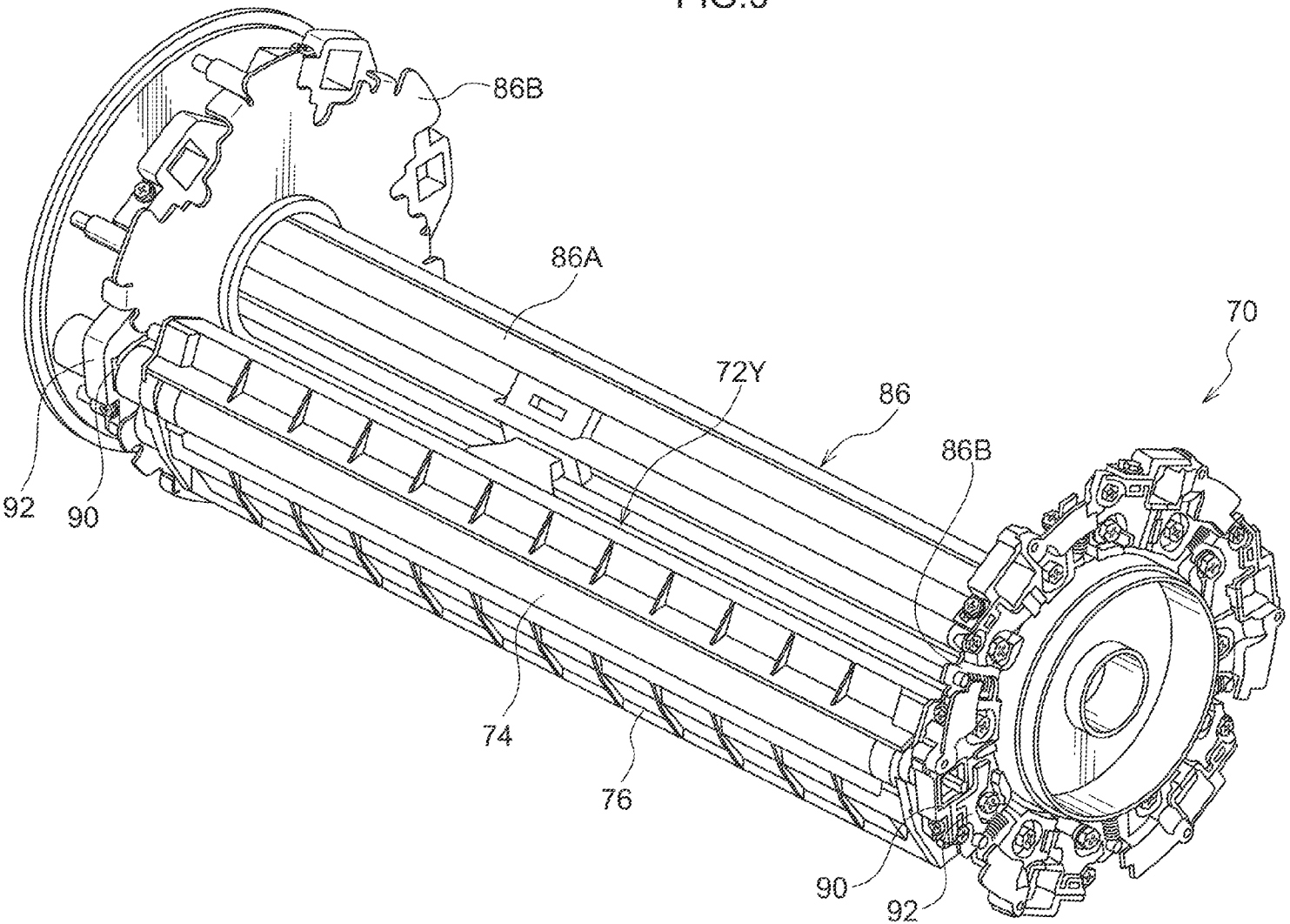
FIG. 3 is a perspective view showing a constitution of a developing device according to the present exemplary embodiment.

As shown in FIGS. 2 and 3, the developing device 70 includes a rotating body 86 rotatably supported with respect to the device body 10A (see, FIG. 1). The rotating body 86 is configured to include a rotating shaft member 86A extending along a direction of the rotating shaft thereof and flange-shaped members 86B provided respectively at the axial direction both end portions of the rotating shaft member 86A and extending (overhanging), in the form of a flange, to the radial direction outer side of the rotating shaft member 86A.

In a space between the two flange-shaped members 86B, developing units 72Y, 72M, 72C, 72K, 72E, and 72F are arranged with in the circumferential direction of the rotating shaft member 86A (in this order in the counterclockwise direction in FIG. 2). The developing units 72Y, 72M, 72C, 72K, 72E, and 72F correspond respectively to the toner colors yellow (Y), magenta (M), cyan (C), black (K), the first special color (E), and the second special color (F). In FIG. 3, only the developing unit 72Y is illustrated, and the illustration of the developing units 72M, 72C, 72K, 72E, and 72F is omitted.

In the developing device 70, as shown in FIG. 2, the rotating body 86 is rotated by a central angle of 60° in the arrow +R direction by a motor (not shown in the drawings) as a rotating section, whereby the developing units 72Y, 72M, 72C, 72K, 72E, and 72F performing developing processing are switched to face the outer peripheral surface of the photoreceptor 62. Since the developing units 72Y, 72M, 72C, 72K, 72E, and 72F have a similar constitution to each other, only the developing unit 72Y will be described here, and the description of the other developing units 72M, 72C, 72K, 72E, and 72F is omitted.

The developing unit 72Y includes a case member 76 which is a main body. The case member 76 is filled with a developer (not shown in the drawings) constituted of carrier and toner supplied from a toner cartridge 78Y (see, FIG. 1) through a toner supply path (not shown in the drawings). The case member 76 includes a rectangular opening 76A formed so as to face the outer peripheral surface of the photoreceptor 62. In the opening 76A, a developing roll 74 is provided with the outer peripheral surface thereof facing the outer peripheral surface of the photoreceptor 62. The developing roll 74 is rotatably supported by the case member 76. A plate-like regulating member 79 for regulating a layer thickness of the developer conveyed by the developing roll 74 is provided at a portion near the opening 76A inside the case member 76 along the longitudinal direction of the opening 76A.

The developing roll 74 is configured to include a cylindrical developing sleeve 74A provided rotatably and a magnetic member 74B fixed to the inside of the developing sleeve 74A and constituted of plural magnetic poles. In the developing roll 74, the developing sleeve 74A rotates to thereby form a magnetic brush of a developer (carrier), and the layer thickness is regulated by the regulating member 79 to thereby form a developer layer on the outer peripheral surface of the developing sleeve 74A. The developer layer on the outer peripheral surface of the developing sleeve 74A is conveyed to the position of facing the photoreceptor 62, and toner corresponding to a latent image (electrostatic latent image) formed on the outer peripheral surface of the photoreceptor 62 is adhered, and then the latent image is developed.

The case member 76 includes two spiral formed conveying rollers 77 rotatably arranged in parallel. The two conveying rollers 77 rotate, so that the developer filled in the case member 76 is circulatingly conveyed in the axial direction of the developing roll 74 (in the longitudinal direction of the developing unit 72Y). The six developing rolls 74 of the developing units 72Y, 72M, 72C, 72K, 72E, and 72F are arranged in the circumferential direction so that the interval between the adjacent developing rolls 74 corresponds to the central angle of 60°. In a case where the developing unit 72 is switched to the next developing unit, the developing roll 74 of the next developing unit faces the outer peripheral surface of the photoreceptor 62.

In the developing unit 72Y, components thereof including the case member 76 and the developing roll 74 are integrally constituted. The developing roll 74 is configured not to be displaced with respect to the components including the case member 76.

Figure 4:
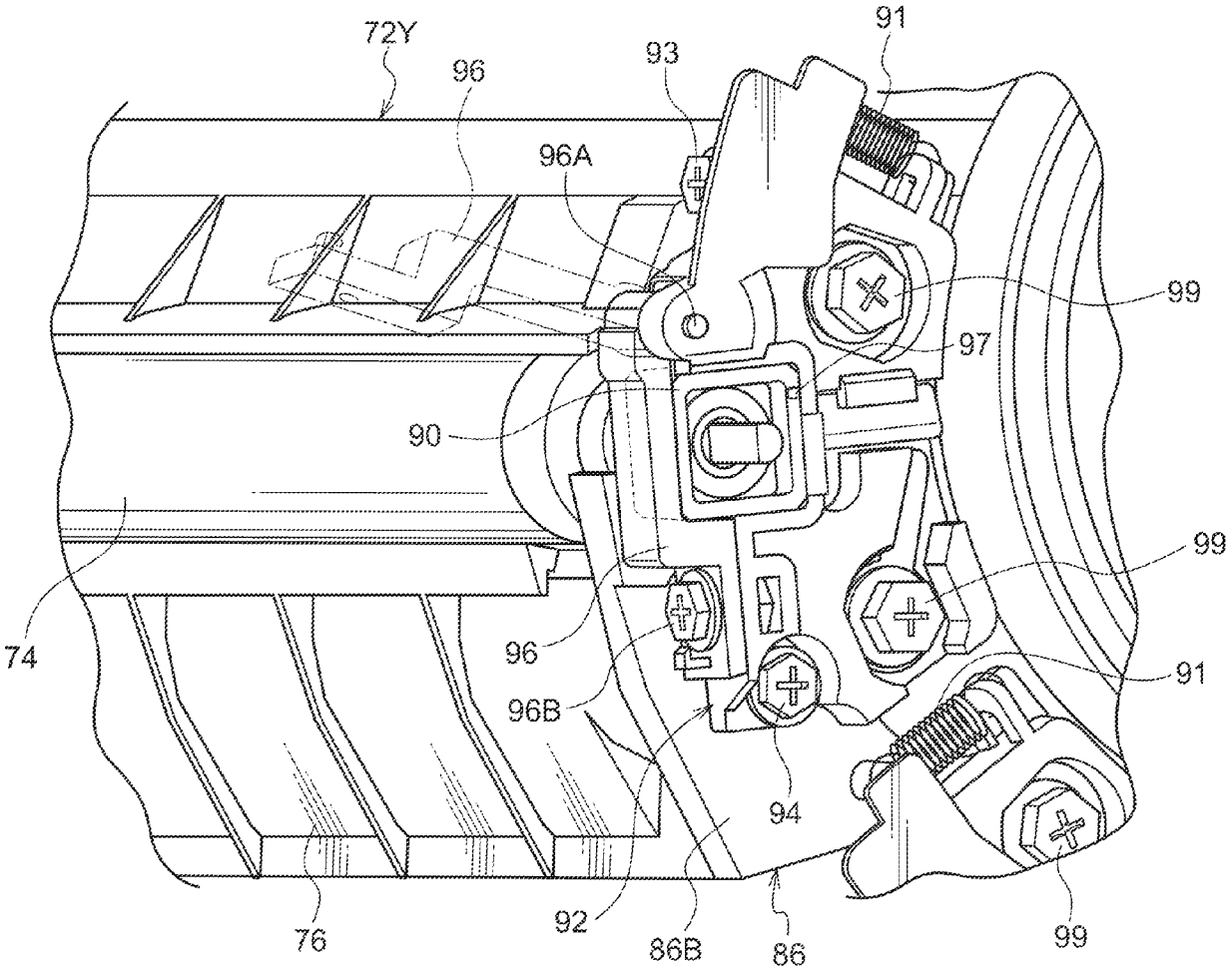
FIG. 4 is a perspective view showing a bearing member and a supporting member of the developing device according to the present exemplary embodiment.
Figure 5:
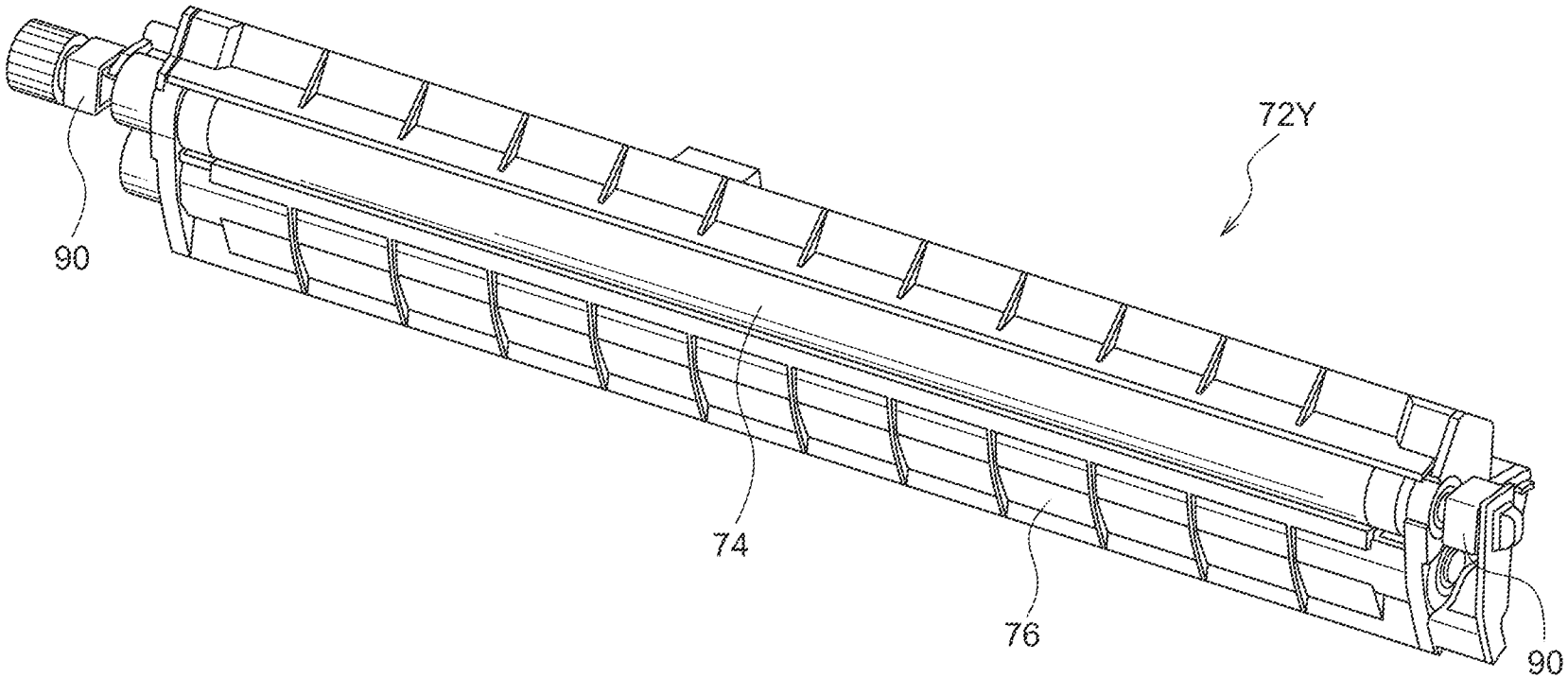
FIG. 5 is a perspective view showing a constitution of a developing unit of the developing device according to the present exemplary embodiment.

As shown in FIGS. 3 and 4, the developing device 70 is provided with bearing members 90 rotatably supporting each of the developing rolls 74 and a supporting members 92 each provided at the flange-shaped member 86B and supporting each of the bearing members 90. As shown in FIG. 5, the bearing members 90 are respectively arranged at the axial direction both end portions of the respective developing rolls 74 and constituted as a pair.

Figure 6:
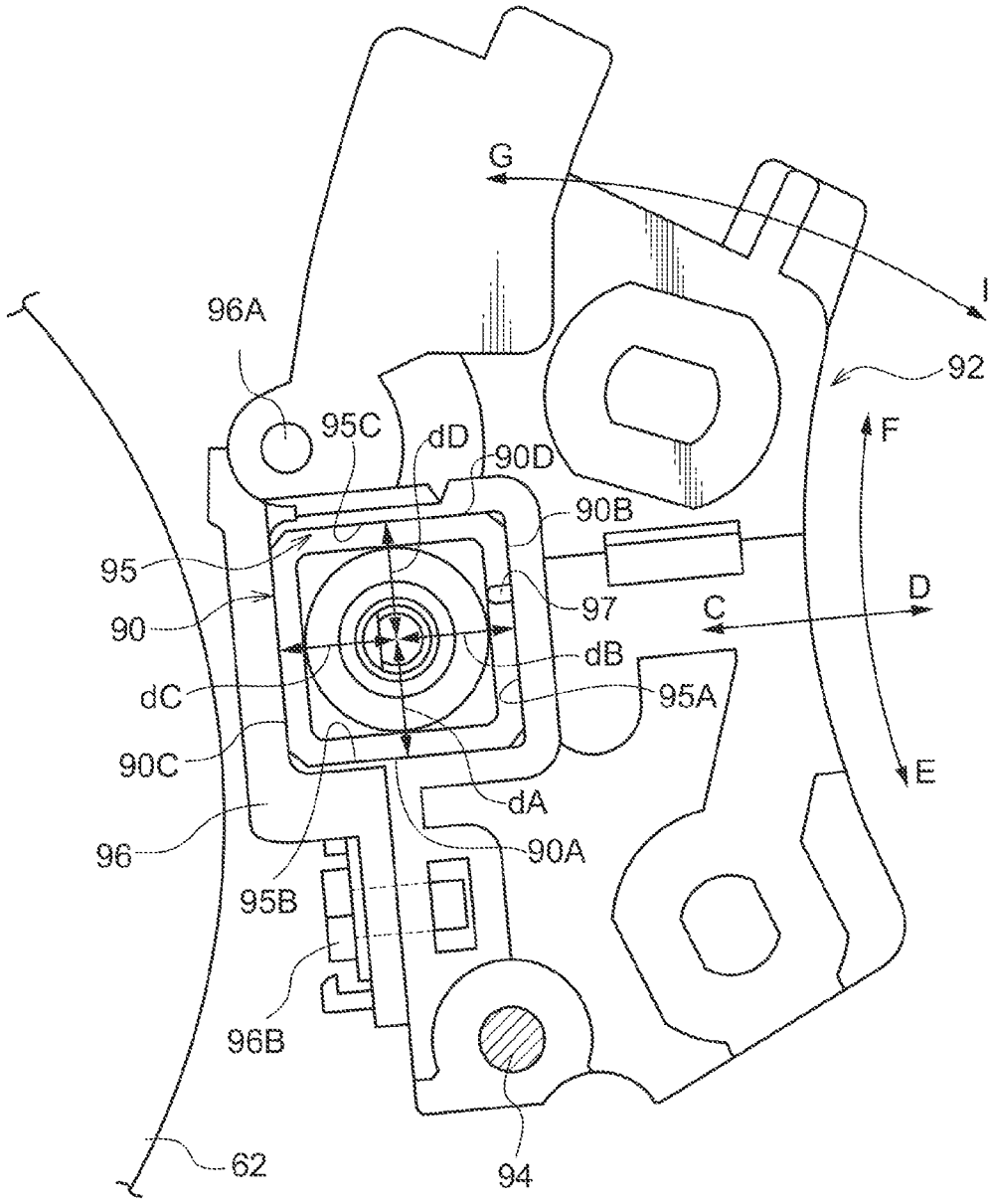
FIG. 6 is a front view showing the bearing member and the supporting member of the developing device according to the present exemplary embodiment.

As shown in FIG. 6, each of the bearing members 90 is formed into a quadrilateral shape in the front view (as viewed from one end side in the axial direction of the developing roll 74), in other word, has a shape formed by being surrounded by four outer side surfaces (outer surfaces) 90A, 90B, 90C, and 90D. A distance between the outer side surfaces 90A and 90D facing each other is equal to a distance between the outer side surfaces 90B and 90C facing each other. Specifically, the bearing members 90 each have a square shape in the front view. The four outer side surfaces 90A, 90B, 90C, and 90D are configured to have different distances dA, dB, dC, and dD which are to the center of the rotation axis of the developing roll 74. Specifically, the distances dA, dB, dC, and dD are set so as to become large in this order by 50 μm from one distance to a next greater distance, for example (that is, dD is larger than dC by 50 μm, dC is larger than dB by 50 μm, dB is larger than dA by 50 μm). An initial setting value (an appropriate value) of an interval between the outer peripheral surface of the developing roll 74 located at the developing position and the outer peripheral surface of the photoreceptor 62 is 400 μm, for example.

The bearing members 90 each have a mark 97 for judging (indicating) which directions the outer side surfaces 90A, 90B, 90C, and 90D are directed. The mark 97 is arranged at a position visually confirmed in the front view (as viewed from the axial direction outer side of the developing roll 74) and is constituted of, for example, a cutout portion, a protrusion or the like formed near any one of the outer side surfaces 90A, 90B, 90C, and 90D. By visually confirming of the mark 97, attitude of the bearing member 90 at the attached state (for example, which outer side surface among the outer side surfaces 90A, 90B, 90C, and 90D is in contact with a bottom surface 95A (reference surface) which will be mentioned later) can be easily visually confirmed.

As shown in FIG. 3, the supporting members 92 are provided in the flange-shaped members 86B provided at the axial direction both end portions of the rotating shaft member 86A and are supported on the axial direction outer side of each of the flange-shaped members 86B. The supporting members 92 each have a plate-like shape (a flat shape) as shown in FIG. 4 and are each formed in a substantially fan-like (sector) shape in the front view as shown in FIG. 6.

Each of the supporting members 92 is supported swingably (rotatably) with respect to each of the flange-shaped members 86B by a swing shaft (rotating shaft) 94, which is disposed on the outer peripheral side of the supporting member 92 (in an arrow C direction in FIG. 6) and on the circumferential direction one end side of the supporting member 92 (in an arrow E direction in FIG. 6). According to this constitution, the circumferential direction other end portion of each of the supporting members 92 (an arrow F direction end portion in FIG. 6) can swing toward the rotating shaft member 86A side (an arrow I direction in FIG. 6) and toward the opposite side thereof (an arrow G direction in FIG. 6).

As shown in FIG. 4, one end portion of a tension coil spring 91 as an example of an elastic member is attached to the circumferential direction other end portion of each of the supporting members 92. The other end portion of the tension coil spring 91 is attached to each of the flange-shaped members 86B. An elastic force allowing movement in the arrow G direction in FIG. 6 is applied to each of the supporting members 92.

The flange-shaped members 86B each have adjustment screws 93 that each allows movement in the arrow I direction in FIG. 6. The front end portion of each of the adjustment screws 93 is abutted against each of the supporting members 92. By each of the adjustment screws 93 being screwed in, each of the supporting members 92 moves in the arrow I direction in FIG. 6. According to this constitution, the position of each of the supporting members 92 can be changed with respect to each of the flange-shaped members 86B (the rotating body 86). Accordingly, the position of each of the developing roll 74 supported by each of the supporting members 92 via each of the bearing members 90 can be changed with respect to the photoreceptor 62.

The supporting members 92 each have two screws 99 as fixing members for fixing each of the supporting members 92 with respect to each of the flange-shaped members 86B (the rotating body 86). After adjustment of the position of each of the supporting members 92 with respect to each of the flange-shaped members 86B (the rotating body 86), each of the supporting members 92 is screw-fastened with respect to the rotating body 86 by the screws 99 to be fixed.

The supporting members 92 each have a recess 95 formed on the outer peripheral side of the supporting member 92 and at the circumferential direction central portion of the supporting member 92. Each of the bearing members 90 is inserted (mounted) from the outer peripheral side into the recess 95 of each of the supporting members 92. Each of the recesses 95 is configured to have the bottom surface 95A and side surfaces 95B and 95C. The bottom surface 95A is formed at a position depressed by one step to the inner peripheral side relative with respect to the outer periphery of each of the supporting members 92 and directs the outer peripheral side. The side surface 95B faces one circumferential direction of the supporting member 92 (the arrow E direction in FIG. 6), and the side surface 95C faces the other circumferential direction (the arrow F direction in FIG. 6).

The bottom surface 95A is a reference surface in contact with the outer side surface of the bearing member 90 to position the bearing member 90. The bottom surface 95A is also a facing surface, which faces toward the photoreceptor 62 in the front view in a case where the developing unit 72 at which the bottom surface 95A is formed is located at the developing position. Specifically, the bottom surface 95A faces the rotation axis center of the photoreceptor 62. Accordingly, by changing of a distance from the bottom surface 95A to the center of the rotation axis of the developing roll 74, an interval between the outer peripheral surface of the developing roll 74 and the outer peripheral surface of the photoreceptor 62 is changed. A minute gap(s) may be formed between the outer side surfaces 90A, 90B, 90C, 90D of the bearing member 90 inserted into the recess 95 and the side surfaces 95B and 95C. Namely, the bearing member 90 may move between the side surfaces 95B and 95C in a direction of tangent passing through the outer peripheral surface of the photoreceptor 62.

In each of the supporting members 92, a holding member 96 holding the bearing member 90 inserted into the recess 95 is rotatably supported by a rotating shaft 96A on the upper side in FIG. 6 of the side surface 95C of the recess 95. A screw 96B fastening the holding member 96 to the supporting member 92 is provided on the free end portion side of the holding member 96.

Specifically, the holding member 96 can be rotated between a holding position (shown by the solid line in FIG. 4), at which the bearing member 90 is held so as to be provided between the holding member 96 and the bottom surface 95A, and a non-holding position (shown by the two-dot chain line in FIG. 4) at which the bearing member 90 can be removed by opening the outer peripheral side of the recess 95. According to this constitution, the holding member 96 is rotated to the non-holding position then the bearing member 90 is removed from the recess 95, and the bearing member 90 is inserted into the recess 95 again then the holding member 96 is rotated to the holding position, whereby the bearing member 90 is mounted to and removed from the supporting member 92.

When the bearing member 90 is removed from the recess 95, the bearing member 90 is rotated with 90° by 90° with respect to the rotation axis of the developing roll 74, whereby the outer side surface among the outer side surfaces 90A, 90B, 90C, and 90D of the bearing member 90 in contact with the recess 95 can be changed to the other outer side surface among the outer side surfaces 90A, 90B, 90C, and 90D.

The rotating body 86 cannot be mounted to and removed from the device body 10A (see, FIG. 1), and the opening and closing portion 10B of the device body 10A (see, FIG. 1) is opened to allow for access to a portion of the outer peripheral surface of the developing device 70. Since the opening and closing portion 10B is provided on the right side surface of the device body 10A (see, FIG. 1), the access to the bearing members 90 on the axial direction both sides of the developing roll 74 is enabled, unlike the constitution in which opening and closing portions are provided on the front and rear sides of the device body 10A.

In the present exemplary embodiment, in the developing roll 74 and the other components of the developing unit 72Y (for example, the case member 76), no contact member (hereinafter referred to as a contact member for specifying (defining) interval) in contact with the outer peripheral surface of the photoreceptor 62 for the purpose of specifying (defining) an interval between the developing roll 74 and the photoreceptor 62. Further, the photoreceptor 62 and the developing device 70 are independently provided in the device body 10A (see, FIG. 1), and the photoreceptor 62 and the developing device 70 are positioned with respect to the device body 10A respectively, so that the interval between the photoreceptor 62 and the developing roll 74 is specified (set).

Accordingly, the present exemplary embodiment does not have a constitution in which the interval between the photoreceptor 62 and the developing roll 74 is directly specified, but have a constitution in which the interval between the photoreceptor 62 and the developing roll 74 is indirectly specified via the device body 10A. As compared with the constitution in which the interval between the photoreceptor 62 and the developing roll 74 is directly specified, in the present exemplary embodiment, the interval between the photoreceptor 62 and the developing roll 74 is highly likely to vary. Thus, in the present exemplary embodiment, the bearing member 90 has the plural outer side surfaces 90A, 90B, 90C, and 90D, having different distances from the center of the rotation axis of the developing roll 74 to the respective outer side surfaces 90A, 90B, 90C, and 90D, so that after-mentioned position adjustment operation of the developing roll 74 to the photoreceptor 62 may be performed in a case where the interval between the photoreceptor 62 and the developing roll 74 varies.

In the present exemplary embodiment, the photoreceptor 62 and the developing roll 74 are positioned via the device body 10A; however, for example, a contact member for specifying interval may be provided with respect to a displacement member (for example, the rotating body 86 or the supporting member 92) which is displaceable with respect to the developing roll 74, and the interval between the developing roll 74 and the photoreceptor 62 may be indirectly specified via the displacement member.

Further, in the present exemplary embodiment, although the recess 95 and the holding member 96 supporting the bearing member 90 are provided with respect to the supporting member 92, the recess 95 and the holding member 96 may be provided with respect to the case member 76 of the developing unit 72Y. In this constitution, since the developing roll 74 can be displaced with respect to the case member 76, the contact member for specifying interval may be provided with respect to the case member 76, and the interval between the developing roll 74 and the photoreceptor 62 may be indirectly specified via the case member 76.

Next, the operation of the present exemplary embodiment will be described.

First, an image formation process in the image forming device 10 will be described.

As shown in FIG. 1, when the image forming device 10 is operated, image data of colors yellow (Y), magenta (M), cyan (C), black (K), the first special color (E), and the second special color (F) are output in sequence from an image processing device (not shown in the drawings) or from outside to the exposure device 66. At that time, as an example, the developing device 70 rotates so that the developing unit 72Y (see, FIG. 2) faces the outer peripheral surface of the photoreceptor 62 and is held.

Subsequently, light emitted from the exposure device 66 in accordance with image data exposes the outer peripheral surface (the surface) of the photoreceptor 62 charged by the charger 64, and an electrostatic latent image corresponding to image data of yellow is formed on the surface of the photoreceptor 62. The electrostatic latent image formed on the surface of the photoreceptor 62 is developed as a toner image of yellow by the developing unit 72Y. The toner image of yellow on the surface of the photoreceptor 62 is transferred onto the intermediate transfer belt 68 by the first transfer roll 67.

Subsequently, as shown in FIG. 1, the developing device 70 is rotated by 60° in the arrow +R direction, and the developing unit 72M faces the surface of the photoreceptor 62. Then, charging process, exposure process, and developing process are performed, and a toner image of magenta on the surface of the photoreceptor 62 is transferred on the toner image of yellow on the intermediate transfer belt 68 by the first transfer roll 67. In a similar manner, toner images of cyan (C), black (K), the first special color (E), and the second special color (F) are multiply transferred in sequence onto the intermediate transfer belt 68.

Meanwhile, the recording paper P fed out from the paper storage unit 12 and transported through the transporting path 28 is transported to the second transfer position by the positioning roll 38 with timing corresponding to the multiple transfer of each toner image onto the intermediate transfer belt 68. The toner image multiply transferred onto the intermediate transfer belt 68 is second-transferred onto the recording paper P which is transported to the second transfer position, by the second transfer roll 71.

Subsequently, the recording paper P transferred with the toner image is transported toward the fixing device 80 in the arrow A direction (the right direction in the drawing). In the fixing device 80, the toner image is heated by the heating roll 82 and pressurized by the pressure roll 84, whereby the toner image is fixed to the recording paper P. The recording paper P fixed with the toner image is discharged to the paper discharge section 15, as an example. In a case where an image is formed on the both sides of the recording paper P, after the image fixation onto the front surface of the recording paper P by the fixing device 80, the recording paper P is fed into the reversing portion 33 to be reversed, and, thus, to be transported to the second transfer position. Then, an image is formed on the rear surface of the recording paper P to be fixed.

Next, the position adjustment operation of adjusting the position of the developing roll 74 with respect to the photoreceptor 62 will be described.

The position adjustment operation is used in, for example, an adjustment operation performed on the user's location after shipment to market. In the fabrication stage of the image forming device 10 before shipment to market, the position of each of the supporting members 92 is adjusted with respect to the rotating body 86 by each of the adjustment screws 93, and each of the supporting members 92 is fixed to the rotating body 86 by the screws 99. According to this constitution, the interval between the developing roll 74 and the photoreceptor 62 is adjusted in advance.

The position adjustment operation to be described hereinafter is performed, for example, in a case where it is confirmed that density unevenness of an image occurs in the width direction of the recording paper P (a direction along the axial direction of the photoreceptor 62) due to that the interval between the developing roll 74 and the photoreceptor 62 is varied at the axial direction by, for example, environmental variation after shipment to market.

In the present exemplary embodiment, at the both end portions of the developing roll 74, a position where the outer side surface 90B of the bearing member 90 is in contact with the bottom surface 95A of the recess 95 is an initial setting position, and at the axial direction one end portion of the developing roll 74, operation of moving closer to the photoreceptor 62 by 100 μm will be described.

In the position adjustment operation, first, an operator opens the opening and closing portion 10B with respect to the device body 10A. In the supporting member 92 supporting the bearing member 90 of the developing roll 74 which is disposed on the opening and closing portion 10B side and will be subjected to the position adjustment operation, the screw 96B fixing the holding member 96 is removed.

The rotating body 86 is in a state of being rotatable, and in a case where the developing roll 74 which will be subjected to the position adjustment operation is not located on the opening and closing portion 10B side, the operator manually rotates the rotating body 86 so that the developing roll 74 which will be subjected to the position adjustment operation is located on the opening and closing portion 10B side. The following construction may be possible: the operator operates an operating section (an operation panel) before the opening of the opening and closing portion 10B, such that the image forming device 10 rotates the rotating body 86 so that the developing roll 74 which will be subjected to the position adjustment operation is located on the opening and closing portion 10B side.

Next, the holding member 96 is rotated to the non-holding position, and the bearing member 90 is removed from the recess 95. Then the bearing member 90 is rotated with respect to the rotation axis of the developing roll 74 to change the directions (orientations) of the outer side surfaces 90A, 90B, 90C, and 90D of the bearing member 90. Then the bearing member 90 is inserted into the recess 95, and the holding member 96 is fixed again by the screw 96B.

By the above operation, the outer side surface among the outer side surfaces 90A, 90B, 90C, 90D in contact with the bottom surface 95A of the recess 95 is changed. In this example, at one end portion of the developing roll 74 on the side where it becomes closer to the photoreceptor 62, the outer side surface in contact with the bottom surface 95A is changed from the outer side surface 90B to the outer side surface 90D. Since the distance dD of the outer side surface 90D is longer by 100 μm than the distance dB of the outer side surface 90B, the above change makes, at one end portion of the developing roll 74 on the side where it becomes closer to the photoreceptor 62, the developing roll 74 move closer toward the photoreceptor 62 by 100 μm.

At one end portion of the developing roll 74 on the side where it becomes closer to the photoreceptor 62, the outer side surface in contact with the bottom surface 95A may be changed from the outer side surface 90B to the outer side surface 90C, and at the opposite end portion, the outer side surface in contact with the bottom surface 95A may be changed from the outer side surface 90B to the outer side surface 90A. The distance dC of the outer side surface 90C is longer by 50 μm than the distance dB of the outer side surface 90B, and the distance dA of the outer side surface 90A is shorter by 50 μm than the distance dB of the outer side surface 90B. Therefore, the above change makes the developing roll 74 move closer toward the photoreceptor 62 by 100 μm at one end portion of the developing roll 74 on the side where it becomes closer to the photoreceptor 62.

As described above, at the axial direction one end portion of the developing roll 74, the position of the rotation axis of the developing roll 74 to the photoreceptor 62 is changed, and the interval between the developing roll 74 and the photoreceptor 62 is uniformized at the axial direction.

In the above example, at the axial direction one end portion of the developing roll 74, the interval between the developing roll 74 and the photoreceptor 62 is adjusted. However, at the axial direction the other end portion of the developing roll 74, the interval between the developing roll 74 and the photoreceptor 62 may be adjusted.

Figure 7A:
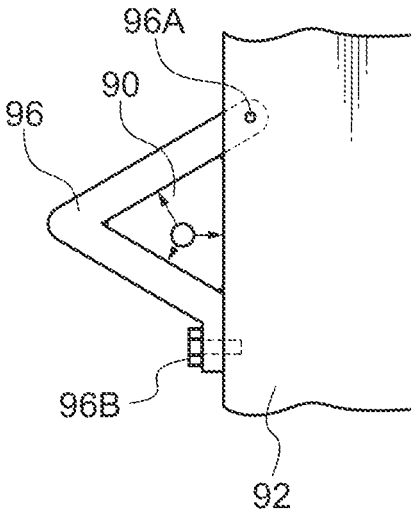
FIGS. 7A and 7B is a front view showing a variation of the bearing member according to the present exemplary embodiment.
Figure 7B:
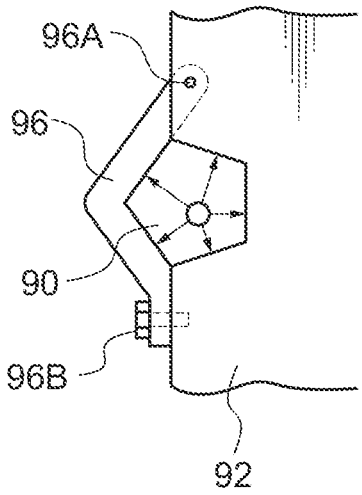

In the present exemplary embodiment, although the bearing member 90 has a quadrilateral shape in the front view, it may have a trilateral shape (see, FIG. 7A) or a shape having five or more sides (see, FIG. 7B).

As shown in FIG. 7A, the recess 95 may not be formed at the supporting member 92, but only reference surface may be formed on the outer peripheral surface of the supporting member 92

Although the bearing member 90 has a structure surrounded by the straight sides in the front view, the bearing member 90 may include a straight line (a plane) and a curved line (a curved surface). In this case, the distances to the center of the rotation axis of the developing roll from the plane are different, and the plane in contact with the bottom surface 95A of the recess 95 is changed. Further, the bearing member 90 may be constituted of a cam having a curved surface whose distance from the center of the rotation axis of the developing roll 74 changes gradually.

In the present exemplary embodiment, although the position of the supporting member 92 can be adjusted with respect to the rotating body 86, there may be provided a configuration in which the position adjustment cannot be performed, or, the supporting member 92 may be provided integrally with the rotating body 86.

In the present exemplary embodiment, although there has been described the case as an example in which the image formation is performed with the six colors of Y, M, C, K, E, and F, the image formation may be performed with the four colors of Y, M, C, and K, or the five colors of Y, M, C, K and the first special color E or the second special color F.

In the present exemplary embodiment, although the developing device 70 is configured to have the developing units of six colors divided by 60°, a developing device having developing units of four colors divided by 90° may be provided, for example.

The invention is not limited to the above embodiment and may be variously modified, changed, and improved. For example, the above variations may be combined and configured.

What is claimed is:

1. A developing device comprising:

a developing roll;

a bearing member that rotatably supports the developing roll, the bearing member having a plurality of outer side surfaces, and each outer side surface of the bearing member being a different distance from a center of a rotation axis of the developing roll respectively; and a supporting member that supports the bearing member in a positioning state where one of the plurality of outer side surfaces is in contact with a reference surface, wherein the one of the plurality of the outer side surfaces in contact with the reference surface is changeable.

2. The developing device of claim 1, wherein the outer side surface which is in contact with the reference surface is changed to another outer side surface among the plurality of outer side surfaces by rotating the bearing member with respect to the rotation axis of the developing roll.

3. The developing device of claim 1, wherein the reference surface is formed at the supporting member at a side of a member facing the developing roll.

4. The developing device of claim 3, wherein the reference surface is formed on a recess portion which is formed at the supporting member at the side of the member facing the developing roll, and the bearing member is mounted in the recess portion.

5. The developing device of claim 1, wherein a mark by which attitude of the bearing member in a mounted state thereof is visually confirmed is formed at the bearing member.

6. The developing device of claim 1, wherein a holding member that holds the bearing member supported at the supporting member is provided at the supporting member.

7. The developing device of claim 1, wherein a set of the bearing member and the supporting member is provided at each end portion in the rotation axis direction of the developing roll.

8. The developing device of claim 1, wherein the bearing member is quadrilateral in shape.

9. The developing device of claim 8, wherein the bearing member is square in shape.

10. The developing device of claim 1, wherein the distance between the reference surface and the center of the rotation axis of the developing roller depends on the one of the plurality of outer side surfaces contacting the reference surface.

11. The developing device of claim 10, wherein the distance between a photoreceptor and the developing roller depends on the one of the plurality of outer side surfaces contacting the reference surface.

12. The developing device of claim 1, wherein the outer side surfaces each include a plane surface, and a portion of the reference surface, with which the plane surface of the outer side surface is in contact, is a plane surface.

13. An image forming device comprising:

a photoreceptor that is supported by a device body of the image forming device; and a developing device including:

a developing roll;

a bearing member that rotatably supports the developing roll, the bearing member having a plurality of outer side surfaces, and each outer side surface of the bearing member being a different distance from a center of a rotation axis of the developing roll respectively; and a supporting member that supports the bearing member in a positioning state where one of the plurality of outer side surfaces is in contact with a reference surface which faces a rotation axis center of the photoreceptor, wherein the one of the plurality of the outer side surfaces in contact with the reference surface is changeable, the reference surface faces a side of the photoreceptor, and which is supported by the device body independently from the photoreceptor.

14. The image forming device of claim 13, wherein the outer side surface which is in contact with the reference surface is changed to another outer side surface among the plurality of outer side surfaces by rotating the bearing member with respect to the rotation axis of the developing roll.

15. The image forming device of claim 13, wherein the reference surface is formed at the supporting member at a side of a member facing the developing roll.

16. The image forming device of claim 15, wherein the reference surface is formed on a recess portion which is formed at the supporting member at the side of the member facing the developing roll, and the bearing member is mounted in the recess portion.

17. The image forming device of claim 13, wherein a mark by which attitude of the bearing member in a mounted state thereof is visually confirmed is formed at the bearing member.

18. The image forming device of claim 13, wherein the distances are set so as to increase by a predetermined value.

19. The image forming device of claim 13, wherein a holding member that holds the bearing member supported at the supporting member is provided at the supporting member.

20. The image forming device of claim 13, wherein a set of the bearing member and the supporting member is provided at each end portion in the rotation axis direction of the developing roll.

* * * * *